US005435439A

United States Patent [19]

Swart

[11] Patent Number: 5,435,439

[45] Date of Patent: Jul. 25, 1995

[54] CIGARETTE PACK LIFTING STRIP

[75] Inventor: Pierre R. Swart, Stellenbosch, South Africa

[73] Assignee: Tobacco Research & Development Institute Limited, Vaduz, Liechtenstein

[21] Appl. No.: 41,252

[22] Filed: Apr. 1, 1993

[30] Foreign Application Priority Data

Apr. 1, 1992 [ZA] South Africa ..... 92/2376
May 26, 1992 [ZA] South Africa ..... 92/3838

[51] Int. Cl.[6] ..... B65D 85/10

[52] U.S. Cl. ..... 206/249; 206/250; 206/255

[58] Field of Search ..... 206/249, 250, 254, 255, 206/268, 271, 273, 804

[56] References Cited

U.S. PATENT DOCUMENTS

| | | | |
|---|---|---|---|
| 2,812,057 | 11/1957 | Brownfield | 206/254 |
| 2,849,154 | 8/1958 | Gartrell et al. | 206/254 |
| 3,108,711 | 10/1963 | Anton | 206/254 |
| 4,664,310 | 5/1987 | Schmidt | 206/255 |
| 4,746,012 | 5/1988 | Simard | 206/254 |
| 4,942,961 | 7/1990 | Focke et al. | 206/254 |
| 4,949,841 | 8/1990 | Focke et al. | 206/254 |

FOREIGN PATENT DOCUMENTS

| | | |
|---|---|---|
| 642831 | 9/1950 | United Kingdom . |
| 780210 | 2/1955 | United Kingdom . |
| 841314 | 7/1960 | United Kingdom . |

*Primary Examiner*—Jimmy G. Foster
*Assistant Examiner*—Thomas P. Hilliard
*Attorney, Agent, or Firm*—Cushman Darby & Cushman

[57] ABSTRACT

The invention relates to a blank arranged to be folded into an inner wrapper for wrapping a bundle of articles such as cigarettes within a pack. The blank comprises a fixed portion which is anchored relative to the pack and a displaceable portion which is arranged to lift at least one of the cigarettes clear of the bundle of cigarettes while facilitating subsequent removal thereof from the pack. The displaceable portion comprises a cover flap for covering the accessible ends of the article which are exposed on opening of the pack, and a lifting strip joined to the cover flap. The cover flap is arranged to tear away from the lifting strip only once at least one of the cigarettes has been lifted clear of the bundle of cigarettes under influence of the lifting strip.

8 Claims, 7 Drawing Sheets

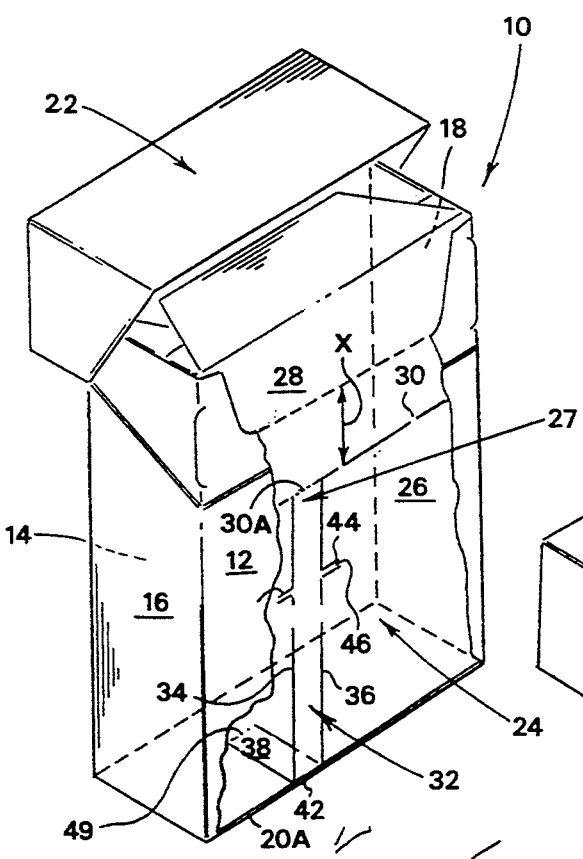
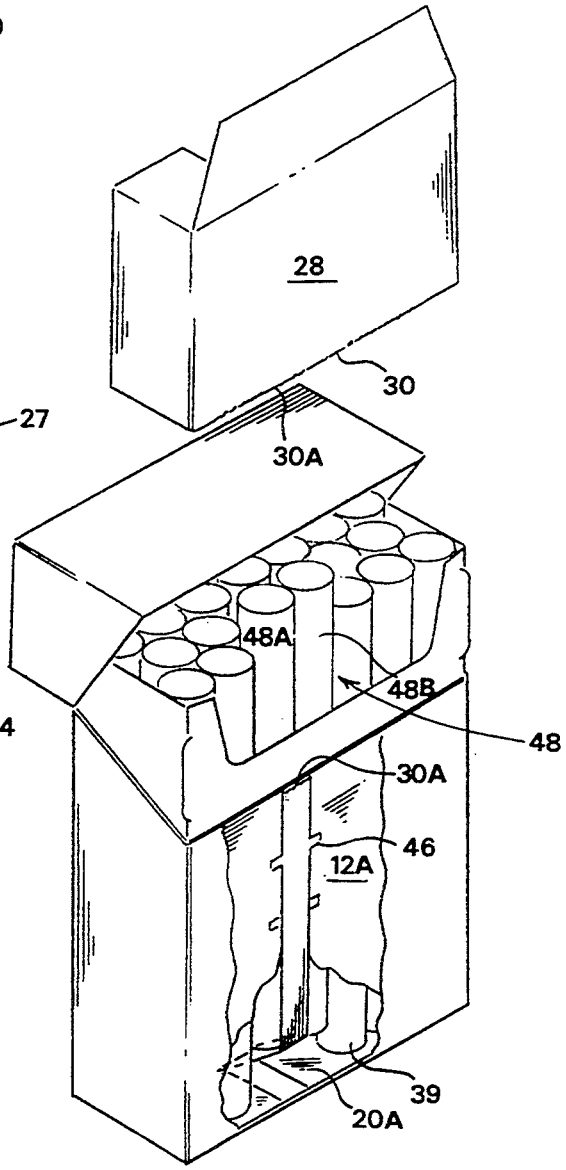
2
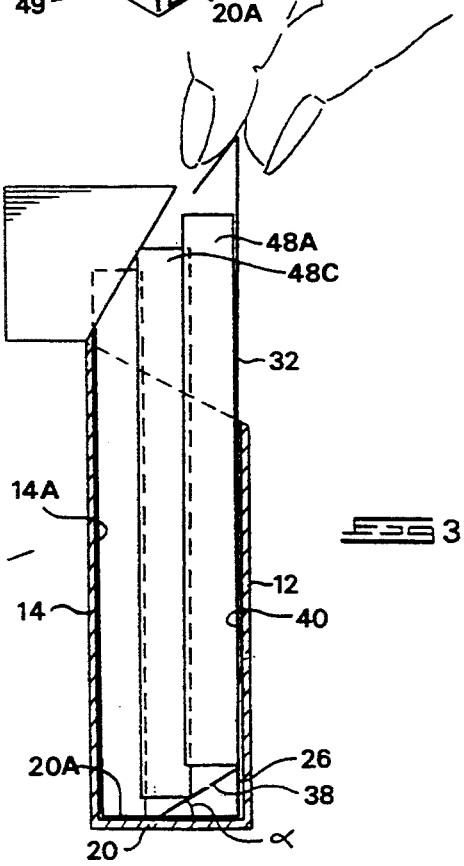
3

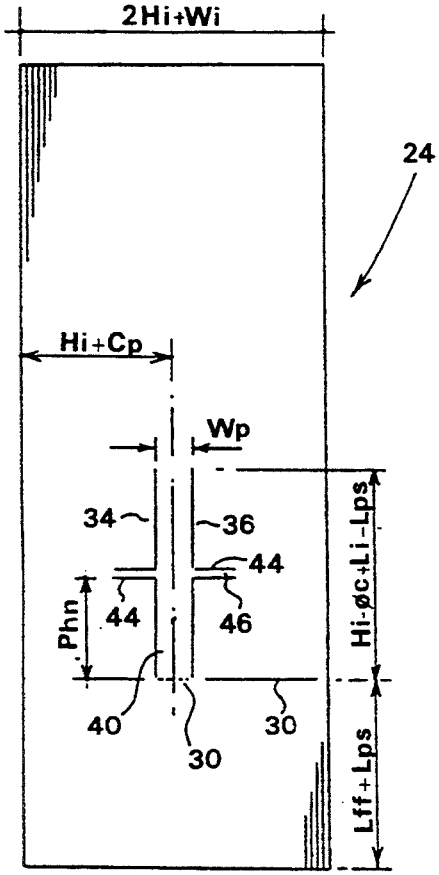
4A
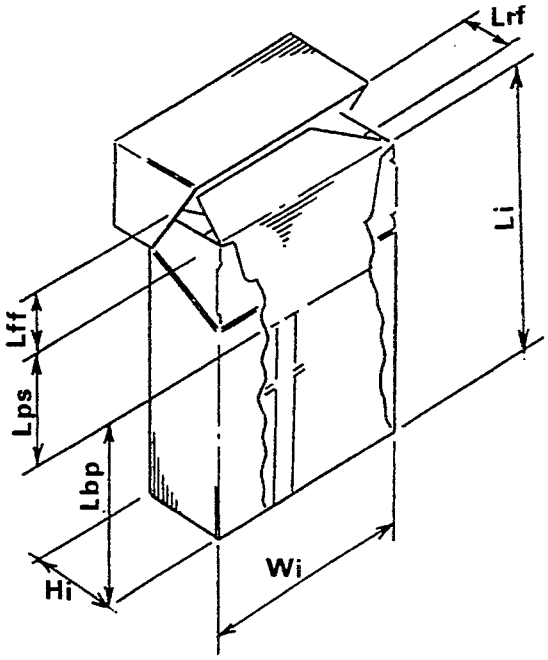
4B
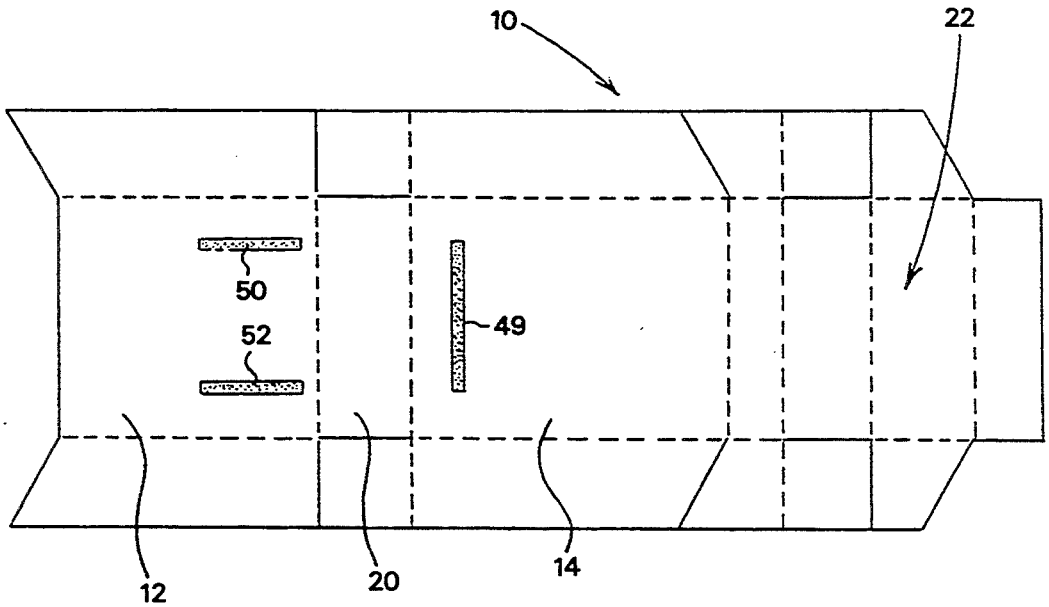
5

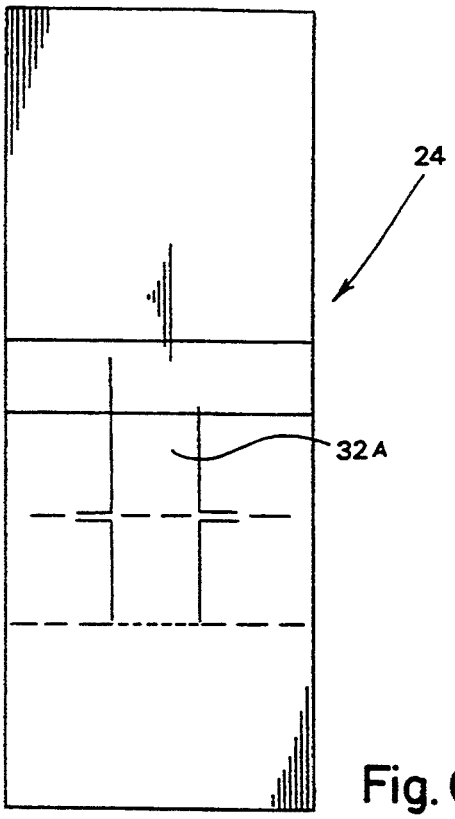
Fig. 6A1
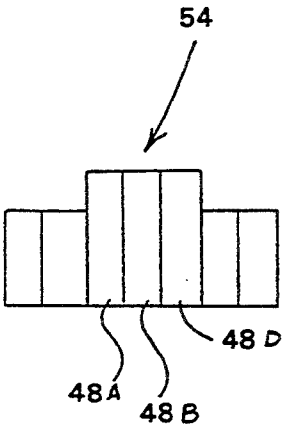
Fig. 6A2
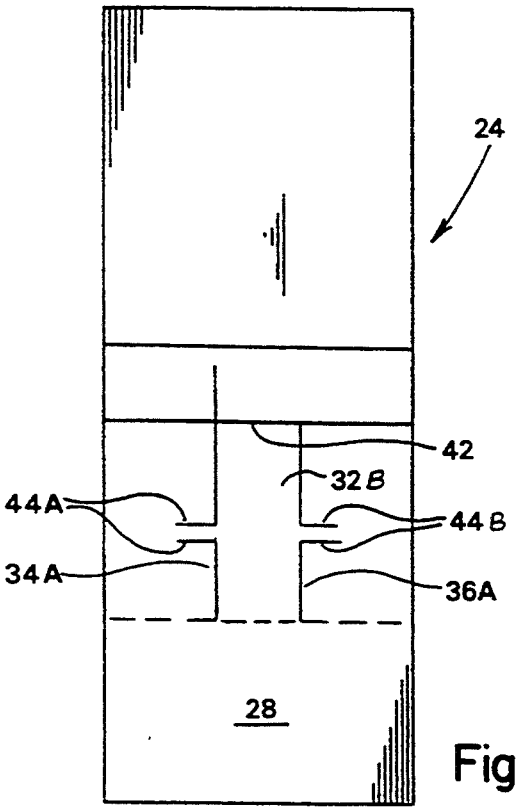
Fig. 6B1
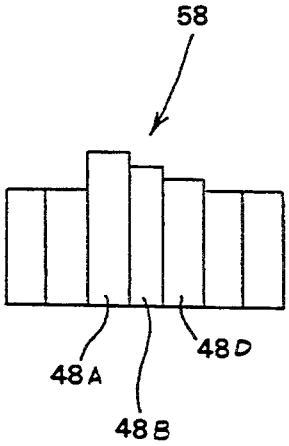
Fig. 6B2

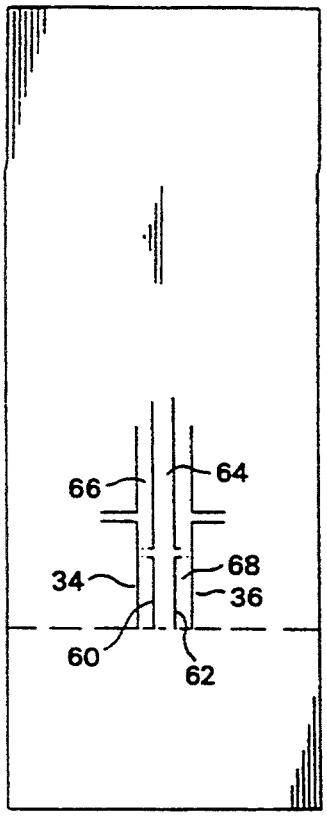
Fig. 6C1
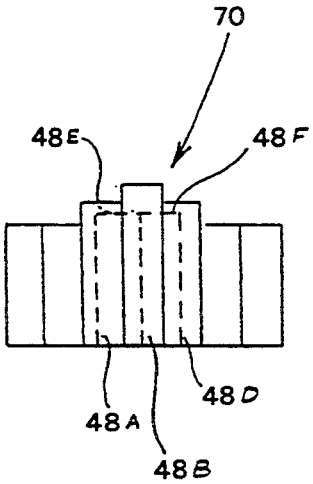
Fig. 6C2
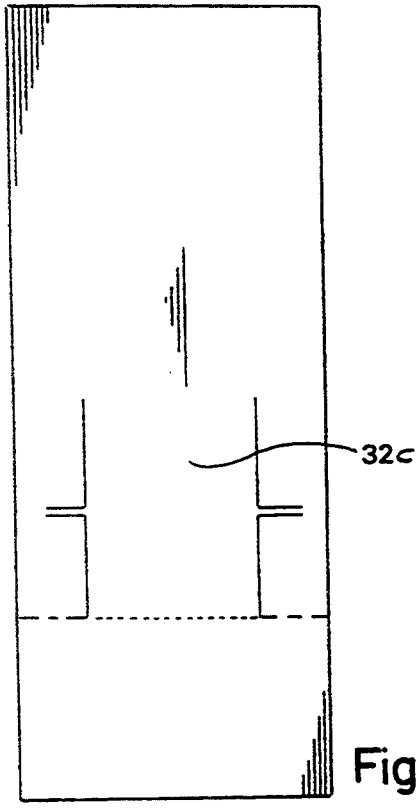
Fig. 6D1
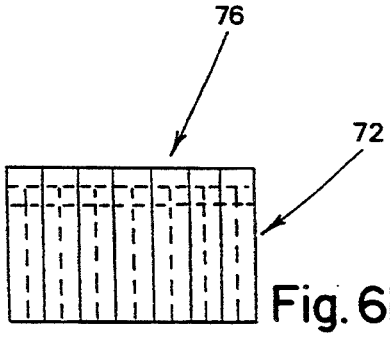
Fig. 6D3
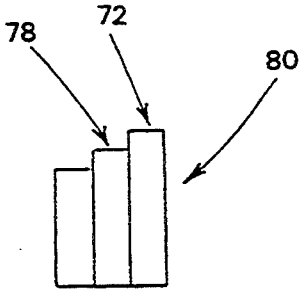
Fig. 6D2

CIGARETTE PACK LIFTING STRIP

BACKGROUND TO THE INVENTION

This invention relates to a lifting strip, and in particular to a lifting strip for lifting one or more cigarettes clear of a bundle of cigarettes in a cigarette box or packet after the packet has been opened.

So-called "crush-proof" cigarette boxes generally contain twenty or thirty closely packed cigarettes. On opening of the cigarette box, all of the closely packed cigarette filter ends lie flush with one another, and it is consequently difficult to obtain a grip on the first cigarette to be extracted. Naturally, once the first few cigarettes have been removed from the box, removal of the remaining cigarettes is made considerably easier as they are now loosely arranged in the box.

It is one object of the invention to facilitate the removal of the first few cigarettes in a crush-proof cigarette box on opening of the box.

SUMMARY OF THE INVENTION

According to the invention there is provided a blank arranged to be folded into an inner wrapper for wrapping a bundle of articles within a pack, the blank comprising a fixed portion which is anchored relative to the pack and a displaceable portion which is arranged to lift at least one of the articles clear of the bundle of articles for facilitating subsequent removal of the article from the pack, the displaceable portion comprising a cover flap for covering those portions of the articles which are exposed on opening of the pack, and a lifting strip joined to the cover flap, whereby the cover flap is arranged to tear away from the lifting strip only once at least one of the articles have been lifted clear of the bundle of articles under influence of the lifting strip.

In a preferred form of the invention, the lifting strip has a distal end joined permanently to the fixed portion and located beneath the bundle of articles, and a free end joined detachably at a weakened zone to the cover flap, the cover flap being arranged to tear away from the lifting strip at the weakened zone.

Conveniently, the wrapper is arranged to be folded along fold lines so as to define a first wall, a second opposed wall and a third wall extending between the first and second walls, the bundle of articles being arranged between the first and second walls, with distal ends of the articles abutting the third wall, the cover flap being located adjacent the first wall and the lifting strip being defined by spaced parallel cut lines which extend through the first wall and into the third wall, with the lifting strip terminating short of the second wall.

That part of the lifting strip which extends through the first wall advantageously comprises a bridging portion, and that part of the lifting strip which extends into the third wall comprises a lifting portion, the cover flap being arranged to tear from the lifting strip without the bridging portion of the lifting strip being visibly exposed at an opening of the pack.

The weakened zone is typically defined by a first perforated cut line which is co-linear with a second cut line separating the cover flap from the fixed portion.

The second cut line is preferably a perforated cut line having perforations which are more extensive than those of the first perforated cut line, and a pair of horizontal spaced nicks extend from opposite sides of the lifting strip so as to define frangible webs interconnecting the lifting strip and the fixed portion, whereby the frangible webs are arranged not to hamper upward movement of the lifting strip while maintaining the integrity of the blank against transverse pulling forces.

In one embodiment of the invention, the lifting strip may be defined by a pair of parallel cut lines of uneven length, thereby to define a lifting strip having an angled fixed end for allowing a row of articles to be raised in a staggered formation.

A plurality of lifting strips may alternatively be provided adjacent one another, the lifting strips being defined by at least three parallel cut lines. In this embodiment, the plurality of lifting strips may comprise an inner lifting strip flanked by a pair of adjacent outer lifting strips, the inner lifting strip being longer than the outer lifting strips, and being arranged to lift a central article further than a pair of flanking articles.

According to a further aspect of the invention there is provided blank arranged to be folded into an inner wrapper for wrapping a bundle of articles within a pack, the blank comprising a fixed portion which is anchored relative to the pack and a displaceable portion which is arranged to lift at least one of the articles clear of the bundle of articles for facilitating subsequent removal of the article from the pack, the displaceable portion comprising a cover flap for covering accessible ends of the articles which are exposed on opening of the pack, and a lifting strip extending from the cover flap into the fixed portion, the lifting strip comprising a lifting portion arranged to be located beneath the distal ends of the articles, where it is joined to the fixed portion, and a bridging portion extending between the lifting portion and the cover flap.

Preferably, the cover flap is arranged to separate from the bridging portion at a weakened zone at a predetermined tension which corresponds to a predetermined acute angle being reached between the lifting portion and a base of the pack adjacent the lifting portion.

The pack may be a hinged lid pack, the articles may be cigarettes and the wrapper may be a foil wrapper.

BRIEF DESCRIPTION OF THE DRAWINGS

FIG. 1 shows a partly cut-away perspective view of a half-opened cigarette box incorporaring one embodiment of a lifting strip arrangement of the invention;

FIG. 2 shows a partly cut-away perspective view showing the lifting strip of FIG. 1 in a raised position;

FIG. 3 shows a partly cut-away side view of the cigarette box and lifting strip arrangement of FIG. 2;

FIG. 4A shows a folded out plan view of a cigarette box wrapper blank incorporating a lifting strip arrangement of the invention with various dimensions marked thereon;

FIG. 4B shows the perspective view of FIG. 1 with the dimensions of FIG. 4A marked thereon.

FIG. 5 shows a folded out plan view of a cigarette box blank of the invention indicating the location of glue lines;

FIGS. 6A1 to 6D3 show various further embodiments of lifting strip arrangements of the invention;

DESCRIPTION OF EMBODIMENTS

Figure 7:
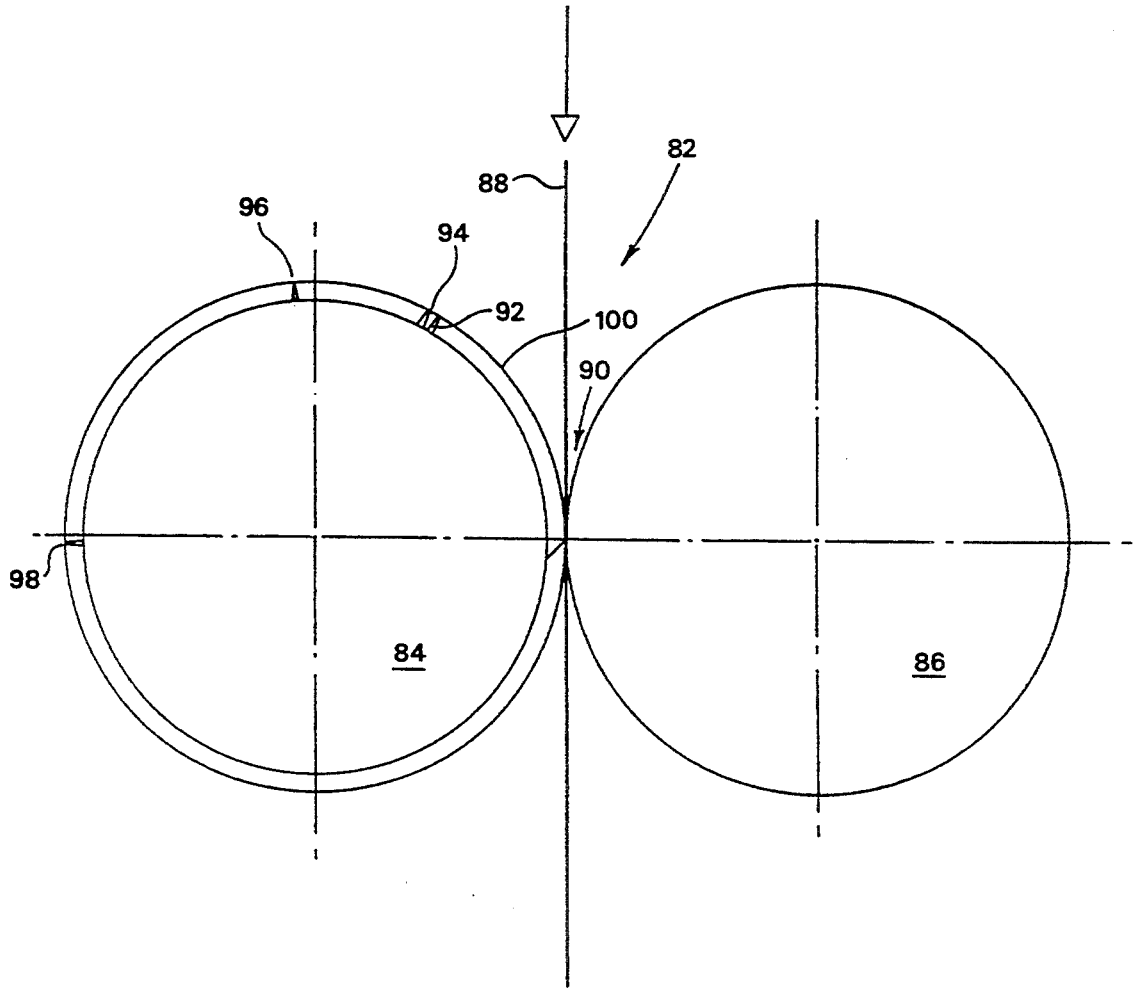
FIG. 7 shows a schematic side view of a rotary cutting roller unit used in the manufacture of the various lifting strip arrangements.

Referring to FIGS. 1 to 3, a crush-proof hinged lid cigarette box 10 is paralellipidedal in form, having front and rear walls 12 and 14 joined by side walls 16 and 18 and a base wall 20. A lid 22 is hinged to the top of the rear wall 14. As is customary, a foil lining or wrapper 24 lines the inner walls of the cigarette box 10, for keeping the cigarettes within the wrapper fresh. The wrapper 24 is folded into corresponding front and rear walls 12A and 14A and a base wall 20A. The wrapper 24 comprises a fixed portion 26 which is glued to the walls of the box and a displaceable portion 27 including a detachable cover flap 28 which is joined temporarily to the fixed portion 26 along a perforated cut line 30. The displaceable portion also includes a lifting strip 32 defined in the wrapper 24 by parallel cut lines 34 and 36 which extend vertically downwards from the perforated line 30 to connect with the fixed section 26 of the wrapper. The cut lines 34 and 36 terminate in a base wall 20A of the wrapper where they define a lifting portion 38 located directly beneath the distal ends 39 of cigarettes when packed in the box.

The lifting strip 32 comprises both the lifting portion 38 and a bridging portion 40 which extends alongside the cigarettes between the lifting portion 38 and the cover flap 28. It is clear from the drawing that the bridging portion 40 is folded at right angles to the lifting portion 38 along a fold line 42. Those perforations 30A between the bridging portion 40 and the flap 28 defining a weakened zone are less extensive than the perforations 30. As a result, when the cover flap 28 is pulled upwards, the flap will separate from the fixed portion 26 of the wrapper while the strip 32 remains joined to the flap 28. Horizontal nicks 44 are formed in the fixed section 26 so as to define webs 46 which form frangible connections between the strip 32 and the fixed section 26. These webs 46 are used to establish temporary connections for strengthening the wrapper in the region of the cuts or slits 34 and 36 in the transverse direction, while tearing easily in the longitudinal direction of pulling.

Turning now to FIG. 3, as the cover flap 28 is gripped and raised after the lid 22 has been opened, the flap 28 carries with it the strip 32 while the fixed portion 26 of the wrapper remains in position. Initially, all the cigarettes 48 in the box are tightly packed together with the upper surfaces of the filter tips all lying flush with one another. The effect of pulling on the flap 28 is to cause the lifting portion 38 of the strip to be raised via the bridging portion 40. This serves to raise the cigarettes 48A and 48B clear of the remaining cigarettes by approximately 7 mm. Once an angle $\alpha$ has been reached, then continued pulling on the flap 28 will cause the flap 28 to separate from the lifting strip 32 along the perforations 30A, as is shown in FIG. 2. The total upward displacement of the lifting strip, which essentially equals the unraised length of the lifting portion 38 multiplied by tan $\alpha$, is approximately 7 mm. This distance is less than the distance X between the top horizontal edge of the front collar and the perforation 30A. As a result, the unsightly torn edge of the strip at the perforation 30A remains hidden from view once the cigarettes 48A and 48B have been lifted.

On initial raising of the lifting strip, the webs 46 also tear away from the front wall 12A of the wrapper, as is clear from FIG. 2. The perforation 30A is so constructed that it is unable to resist the increase in pulling force once the angle $\alpha$ has been reached. This angle equals approximately 30°. It is clear that the tension in the lifting portion 38 will never exceed the tension in the bridging portion 40 owing to the frictional forces arising mainly at the corner of the cigarette 48A adjacent the fold 42. As a result, there is little danger of the lifting strip tearing off at its fixed end 49.

A substantial increase in pulling force on the cover flap is required to displace the cigarettes 48A, 48B and 48C after the angle $\alpha$ has been reached. The weakened zone is arranged to tear at a pulling force of approximately 0.3N, which corresponds to the force required to lift the front cigarettes approximately 7 mm, with the lifting portion at an approximate corresponding angle $\alpha$ of 30°. The cigarettes 48A and 48B, as well as a cigarette 48C behind these front two cigarettes may now easily be removed from the box, as they have been lifted clear of the remaining cigarettes.

Referring now to FIG. 4A, an unfolded plan view of the foil wrapper blank 24 is shown with the various dimensions indicated thereon. In FIG. 4B, the corresponding dimensions are shown in a cut-away perspective view identical to that shown in FIG. 1. The drawings are largely self-explanatory. The key to the various dimensions is as follows:

$L_{ff}$=length of front flap tab of wrapper
$L_{rf}$=length of rear flap tab of wrapper
$L_i$=internal length of box
$H_i$=internal depth of box
$W_i$=internal width of box
$L_{bp}$=length of bridging portion of lift strip
$\phi c$=diameter of cigarette
$P_{hn}$=position of horizontal nics
$C_p$=centre position of cigarettes to be lifted
$W_p$=width of lifting strip Referring now to FIG. 5, the position of a horizontal glue line 49 on the inner surface of the rear wall 14 of the box blank 10 is shown. The position of vertical glue lines 50 and 52 on the inner surface of the front wall 12 of the box is also indicated. The glue lines are applied to the box blank, and the foil wrapper 24 is then stuck into position.

The width $W_p$ of the lifting strip 32 determines the number of cigarettes which are to be lifted. Therefore, by increasing the width of this strip, more cigarettes may be lifted, and by decreasing the width of the lifting strip, fewer cigarettes are lifted. The relative heights to which the cigarettes may be lifted may also be altered by varying the depth of the cut lines 34 and 36 in the base wall 20A of the foil wrapper 24.

In FIGS. 6A1 and 6A2, a lifting strip 32A having a width corresponding to the combined diameters of three cigarettes is formed in the foil wrapper 24. This lifting strip 32A consequently lifts three cigarettes 48A, 48B and 48D from the front row of cigarettes in a box, with a uniform clearance of 7 mm, as is shown at 54.

In FIGS. 6B1 and 6B2, a lifting strip 32B is illustrated having offset cut lines 34A and 36A of different lengths. The cut line 34A is deeper than the cut line 36A. Horizontal nics 44A and 44B are formed in the respective cut lines 34A and 36A, so as to define webs. As the lifting strip 32B is pulled by the flap 28, the cigarette 48A adjacent the cut line 34A is displaced to a greater extent than the cigarette 48B, which is in turn displaced more than the cigarette 48D which lies adjacent the cut line 36A, thereby achieving a staggered lift, as is shown at 58.

Referring now to FIGS. 6C1 and 6C2, additional cut lines 60 and 62 are provided inwardly of the cut lines 34 and 36. The cut lines 60 and 62 are deeper than the cut lines 34 and 36. One longer inner lifting strip 64 and a shorter outer lifting strip comprising two sub-strips 66 and 68 are thus effectively provided. As a result, the inner lifting strip 64 will lift the central cigarette 48B more than the outer cigarettes 48A and 48D, as is shown at 70, thereby providing dual staggering. The two cigarettes 48E and 48F behind the cigarettes 48A, 48B and 48D will also be displaced, though to a lesser extent. In FIGS. 6D1, 6D2, and 6D3, a lifting strip 32C is shown having a width of the combined diameters of five or six cigarettes. This lifting strip 32C may be used to lift the entire front row 72 in a cigarette box, as is shown in a front view illustrated at 76. In a side view shown at 80, it can clearly be seen that the second row 78 of cigarettes is also lifted, though to a lesser extent.

It should be appreciated that there are endless variations in the width, depth and the number of cut lines which can be formed in the foil wrapper for providing various lifting configurations, and that FIGS. 6A1 to 6D3 serve as mere examples of a few possible embodiments.

Turning now to FIG. 7, a schematic view of part of a rotary cutting roller unit 82 is shown comprising first and second cutting rollers 84 and 86. A web of wrapping foil 88 is fed into the nip 90 between the rollers 84 and 86. The roller 84 is provided with a pair of closely spaced blades 92 and 94 for forming the horizontal nics 44. A perforated blade 96 is located a distance $P_{hn}$ away from the blades 92 and 94, and is used to provide the perforations 30 and 30A in the web 88. Displaced along the cutting roller 84 a further distance $L_{ff}+L_{ps}$ away from the perforated blades 96 is a cut off blade 98, which slices the web 88 at the appropriate position so as to form individual lengths of wrapping foil 24. Also positioned on the cutting roller 84 is a pair of blades, only one of which is illustrated at 100. These blades are perpendicular to the cutting blades 92, 94, 96 and 98 and are used to form the cut lines 34 and 36 in the wrapping foil 88. Naturally, the length, width and number of these blades may be varied, in order to vary the length, width and number of lifting strips required.

Figure 8:
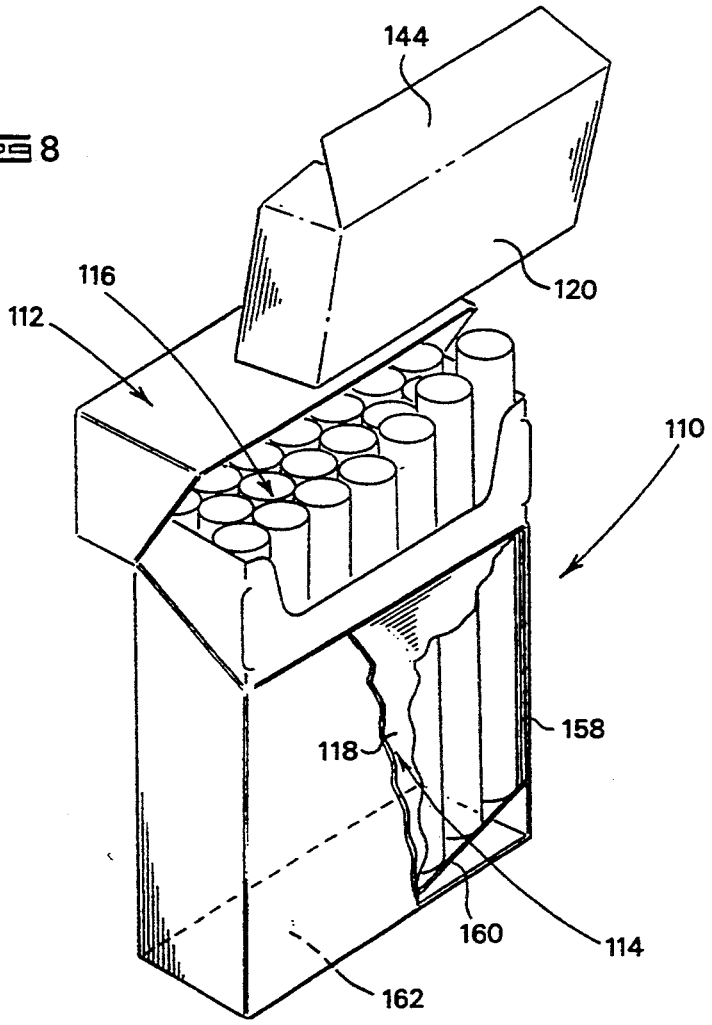
FIG. 8 shows a partly cut-away perspective view of a half-open cigarette box incorporating a still further embodiment of a lifting strip arrangement.

Referring now to FIG. 8, a crush-proof cigarette box 110 similar to the box 10 is paralellipipedal in form, having a lid 112 hinged to the rear wall of the box 110, and a foil lining or wrapper 114 lining the inner walls of the cigarette box 110 for keeping cigarettes 116 fresh within the wrapper 114.

Figure 9:
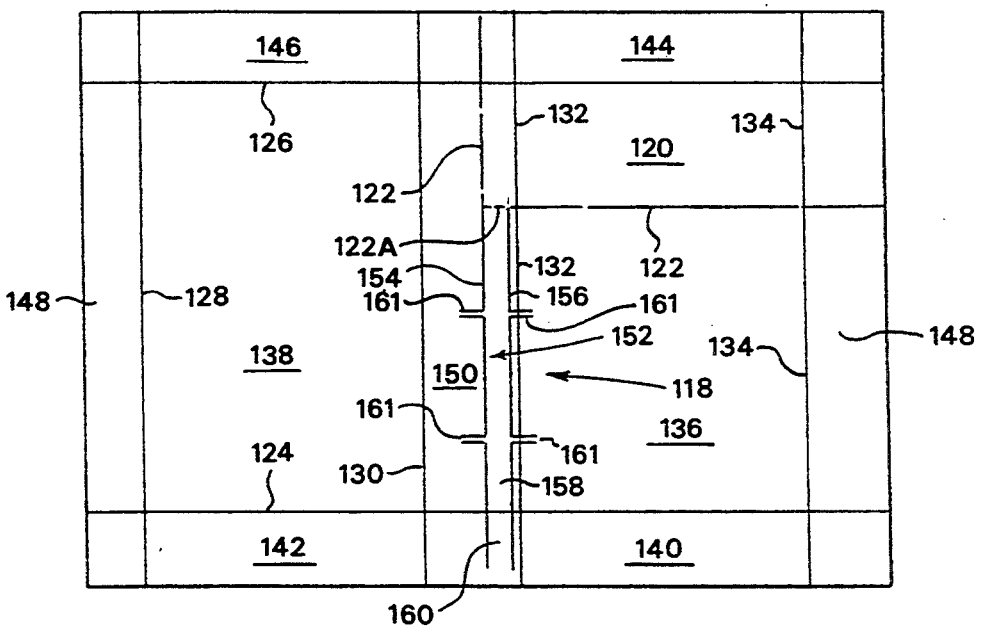
FIG. 9 shows a folded out plan view of a cigarette box wrapper incorporating the lifting strip arrangement of FIG. 8.
Figure 10:
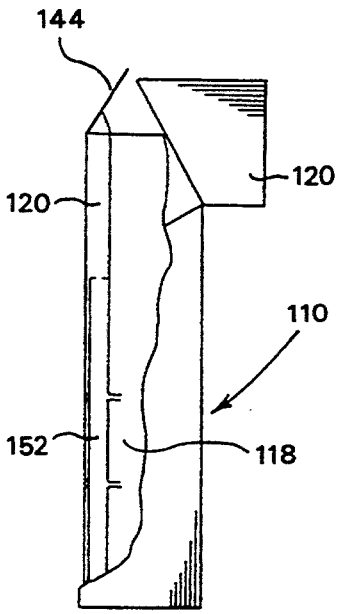
FIG. 10 shows a partly cut-away side view of the cigarette box of FIG. 8.
Figure 11:
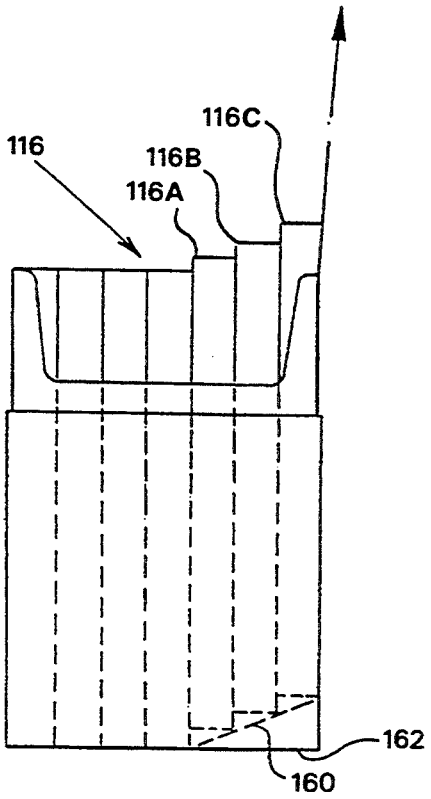
FIG. 11 shows a front view of the cigarette box of FIG. 8.

As can be seen in FIG. 9, the foil wrapper 114 comprises a fixed portion 118 which is glued to the walls of the box and a detachable flap 120 which is joined at intervals to the fixed portion 118 along perforated cut lines 122.

The foil wrapper 114 has respective horizontal fold lines 124 and 126 and vertical fold lines 128, 130, 132, and 134 defining a rectangular front surface or wall 136, a rectangular rear surface 138, front and rear base surfaces 140 and 142, front and rear top surfaces 144 and 146, as well as side surfaces 148 and 150.

A lifting strip 152 is formed in the side surface 150. The lifting strip 152 is defined by a vertical pair of parallel cut lines 154 and 156 which extend downwardly from the detachable flap 120, to which it is linked via a weakened zone in the form of a finely perforated line 122A which forms part of the perforated line 122, but has less extensive perforations. The horizontal fold line 124 divides the lifting strip 152 into a bridging portion 158 and a lifting portion 160 which is formed between the front and rear base surfaces 140 and 142 beneath the side surface 150. Horizontally extending frangible webs 161 connect the lifting strip 152 with the fixed portion 118 of the wrapper. The webs 161 serve to hold the foil wrapper together and preserve its integrity as it is wrapped around the bundle of cigarettes. As can be seen in FIGS. 1 and 4, when the foil wrapper 114 is folded and inserted into the cigarette box 110, the lifting strip 160 extends beneath the three cigarettes 116A, 116B and 116C and adjacent the base 162 of the box.

The removable flap 120 is lifted once the cigarette box has been opened, causing the flap 120 to separate along the perforated lines 122, except at the perforations 122A, where it is joined more firmly to the lifting strip 152. As the flap 120 is lifted further, it carries with it the bridging and lifting portions 158 and 160 of the lifting strip. This causes the lifting portion 160 to lift the three cigarettes 116A, 116B and 116C clear of the base 162 of the cigarette box, while severing the frangible webs 161. Further lifting of the removable cover flap 120 will cause the flap 120 to tear from the lifting strip 152 along the perforated line 122A. As the three cigarettes 116A, 116B, and 116C have been lifted clear of the remaining cigarettes in the pack, it is possible to obtain an easy grip on these raised cigarettes for removing them from the cigarette box 110.

A primary advantage of the lifting strip arrangement of the invention is that it utilises the existing foil wrapper in a cigarette box. Additional lifting tags or strings are therefore not required. The process in producing cigarette boxes and wrappers remains essentially unchanged, with the mere introduction of a rotary cutting unit into the production line being necessary.

A further advantage arises from the overall length of the lifting strip, as well as the manner in which the lifting strip and the cover flap are joined to one another. The lifting strip only extends into the base wall. As a result, the limited length of the cut lines 34 and 36 forming the strip only affect the integrity of the wrapper to a limited extent, as is clear from FIG. 4A of the drawings, for example. This makes folding of the wrapper easier prior to insertion thereof into a cigarette box. The webs 46 also assist in holding the wrapper together, and may even be made long enough so as not to tear away from the fixed portion them the lifting strip is raised, thereby keeping the wrapper substantially intact even after cigarettes have been removed, The weakened zone between the lifting strip and the cover flap is of sufficient strength so as to tear only after the cigarettes have been raised. As a result, the single action of removing the cover flap causes the appropriate cigarettes to be raised, with no unsightly strip end being exposed, and the integrity of the wrapper being substantially preserved.

I claim:

1. A hinge lid cigarette pack comprising a prismatic hinge lid outer pack, an inner wrapper folded from a blank for wrapping a bundle of smoking articles within the pack, the pack having a base and opposed side faces extending from the base and terminating in transverse edges defining an opening opposite the base, the inner wrapper comprising:

a fixed portion which is anchored relative to the pack, and a displaceable portion which is separated from the fixed portion by means of a first transverse cut, the displaceable portion being disposed to lift at least one of the smoking articles clear of the bundle of articles for facilitating subsequent removal of the article from the pack, and comprising a unitary cover flap and lifting tag for covering accessible ends of the articles which are exposed on the opening of the pack, and a lifting strip defined by a pair of parallel cuts which extend in a longitudinal direction from the transverse cut towards and into the base, the lifting strip comprising a lifting portion located beneath distal ends of the articles, adjacent the base of the pack, where said lifting strip is joined permanently to the fixed portion, a bridging portion extending adjacent one of the side faces between the lifting portion and the cover flap and a second perforated cut located a first predetermined distance away from a transverse edge of the one side face and defining a frangible link between the bridging portion and the unitary cover flap and lifting tag, the strength of the frangible link being such that the link is arranged to rupture along the second perforated cut only once those articles which are supported by the lifting portion have been lifted clear of the bundle of articles by the lifting strip on upward pulling of the cover flap and lifting tag, the total upward displacement of the lifting strip prior to rupturing thereof being less than the first predetermined distance, whereby the lifting strip is at no stage visibly exposed over the transverse edges of the pack.

2. A hinge lid pack according to claim 1 wherein the first transverse cut comprises a first perforated cut which is colinear with the second perforated cut, the first perforated cut having perforations which are more extensive than those of the second perforated cut.

3. A hinge lid pack according to claim 1 wherein at least one pair of transverse spaced nicks extend through the parallel cuts on opposite sides of the lifting strip so as to define frangible webs interconnecting the lifting strip and the fixed portion, whereby the frangible webs are of such a length that they do not rupture on initial upward travel of the lifting strip, thereby to maintain the integrity of the wrapper against transverse pulling forces in a region of the lifting strip.

4. A hinge lid pack according to claim 1 wherein the lifting strip is defined by a pair of parallel cuts terminating in a staggered arrangement, thereby to define a lifting strip having an obliquely angled fixed end for allowing a row of articles to be raised in a staggered formation.

5. A hinge lid pack according to claim 1 wherein a plurality of contiguous lifting strips are provided adjacent one another, the lifting strips being defined by at least three parallel cuts terminating in a staggered arrangement, for simultaneously lifting a plurality of cigarettes in a staggered formation.

6. A hinge lid pack according to claim 5 wherein the plurality of lifting strips are defined by a pair of innermost and a pair of outermost parallel cuts and comprise an innermost lifting strip flanked by a pair of contiguous outermost lifting strips, the innermost lifting strip being longer than the outermost lifting strips by virtue of the innermost cuts extending further than the outermost cuts, and being arranged to lift a central article to a greater extent than a pair of flanking articles.

7. A hinge lid pack according to claim 1 wherein the second perforated cut is arranged to rupture at a predetermined tension which corresponds to a predetermined acute angle $\alpha$ being reached between the lifting portion and the base of the pack adjacent the lifting portion.

8. A hinge lid pack according to claim 7 wherein the wrapper is folded along first and second fold lines so as to define a first wall, a second opposed wall and a third wall extending between the first and second walls, the bundle of articles being arranged between the first and second walls, with distal ends of the articles abutting the third wall, the combined cover flap and lifting tag being located adjacent the first wall and the spaced parallel cuts defining the lifting strip extending through the first wall and into the third wall, and terminating short of the second wall, the upward displacement of the lifting strip approximating the length of the lifting portion between the ends of the parallel cuts and the first fold line multiplied by tan $\alpha$.

* * * * *